United States Patent [19]

Sheppard

[11] Patent Number: 4,978,462

[45] Date of Patent: Dec. 18, 1990

[54] COMPOSITIONS AND PROCESS FOR THE TREATMENT OF TEXTILES COMPRISING A RESINOUS BRANCHED POLYORGANOSILOXANE AND A POLYDIORGANOSILOXANE IN AN AQUEOUS DISPERSION

[75] Inventor: Julie H. Sheppard, Leefdaal, Belgium

[73] Assignee: Dow Corning Limited, Barry Wales, Wales

[21] Appl. No.: 404,392

[22] Filed: Sep. 8, 1989

[30] Foreign Application Priority Data

Sep. 28, 1988 [GB] United Kingdom ..... 8822726

[51] Int. Cl.[5] ..... D06M 100/00

[52] U.S. Cl. ..... 252/8.6; 252/8.8; 252/8.9

[58] Field of Search ..... 252/8.6, 8.7, 8.79, 252/8.8, 8.9

[56] References Cited

U.S. PATENT DOCUMENTS

| | | | |
|---|---|---|---|
| 3,634,236 | 1/1972 | Buster et al. | 252/8.9 |
| 3,871,909 | 3/1975 | Aldrich | 252/8.8 |
| 4,767,548 | 8/1988 | Kasprzak et al. | 252/8.8 |

FOREIGN PATENT DOCUMENTS

| | | |
|---|---|---|
| 1088378 | 10/1967 | United Kingdom . |
| 1549180 | 7/1979 | United Kingdom . |

*Primary Examiner*—Paul Leiberman
*Assistant Examiner*—J. Darland
*Attorney, Agent, or Firm*—Jim L. DeCesare

[57] ABSTRACT

Aqueous compositions comprising water having dispersed therein (A) a cationic compound which is substantive to water rinse on textile fabrics and (B) a mixture of (i) a siloxane composed of at least 90% of $RSiQ_{3/2}$ units, in which R is alkyl having from 1 to 8 carbon atoms, and optionally units selected from $$R'_nSiO_{\frac{4-n}{2}}$$

units, in which R′ is phenyl or a 1 to 4 carbon alkyl group, and $C_6H_5SiO_{3/2}$ units and (ii) a polydiorganosiloxane.

The compositions are useful as fabric conditioners in domestic and commercial laundry operations.

12 Claims, No Drawings

COMPOSITIONS AND PROCESS FOR THE TREATMENT OF TEXTILES COMPRISING A RESINOUS BRANCHED POLYORGANOSILOXANE AND A POLYDIORGANOSILOXANE IN AN AQUEOUS DISPERSION

This invention relates to a composition for the treatment of textiles and is concerned in particular with compositions which impart softness to textile fabrics. It also relates to a process for treating textiles with said compositions and to the treated textiles obtained thereby.

Compositions for imparting softness to textile fabrics and which are intended for application during or following laundering have been known and widely used for many years. Such materials are known as, for example 'fabric softeners' or 'fabric conditioning agents' and are generally designed for application during the rinsing stage of the laundering operation. The primary active constituents of such compositions have been cationic surface active compounds, for example the di(hydrogenated-tallow) dimethyl ammonium chlorides, diamido alkoxylated quaternary ammonium compounds and quaternised amido imidazolines. Such compounds are generally poorly soluble in water and are often employed in conjunction with emulsifying aids to assist dispersion.

It has been disclosed in British Patent Specification No. 1 549 180 that additional benefits e.g. easier ironing and pleasant handle can accrue if the cationic compound is applied to the fabric in conjunction with certain silicones. Preferred silicones for use according to G.B. No. 1 549 180 are stated to be those having a cationic character and which show an enhanced tendency to deposit on the fabric. The silicone should also have a viscosity of at least 100 cS and less than 8000 cS at 25° C. Although said compositions have represented a significant advance in the art of fabric softeners there has been a continuing search for improvements in properties such as the feel or drape of the treated fabric and rewettability; the latter property being of particular interest when the fabric is towelling.

British Patent No. 1 088 378 discloses a filament of a synthetic segmented elastomeric copolymer having thereon a lubricating finish comprising 50% or less by weight of a polyamylsiloxane having a viscosity of 8,000 to 20,000 cS at 25° C. and 50% or more by weight of a polydimethylsiloxane having a viscosity of 5 to 100 cS at 25° C. the polyamylsiloxane being present in an amount equal to at least 0.025% by weight of the filament.

According to the present invention there is provided an aqueous composition for the treatment of textiles which comprises water having dispersed therein (A) a cationic compound which is substantive to water rinse on textile fibres, and (B) a mixture comprising (i) from 95 to 55 percent by weight of a polyorganosiloxane wherein at least 90 percent of the siloxane units are those represented by the general formula $RSiO_{3/2}$ in which R represents an alkyl group having from 1 to 8 inclusive carbon atoms, any remaining units in the polyorganosiloxane being selected from units having the general formula $$R_n'SiO_{\frac{4-n}{2}}$$

in which each R' represents an alkyl group having from 1 to 4 carbon atoms or a phenyl group and n has a value of 0, 2 or 3 and $PhSiO_{3/2}$ units in which Ph represents the phenyl group, and (ii) from 5 to 45 percent by weight of a polydiorganosiloxane having a viscosity in the range from 2 to 1000 mPa.s at 25° C. and in which at least 90 percent of the total organic substituents are methyl, any remaining substituents being selected from monovalent hydrocarbon groups having from 2 to 6 carbon atoms.

As Component (A) of the compositions of this invention there may be employed any cationic substance which is substantive to water rinse on textile fabrics and which is capable of imparting softness and/or lubricity to textile fabrics. A large number of such substances is known and includes quaternary ammonium compounds such as:

(a) Alkylmethyl quaternary ammonium compounds having either one $C_{18}$–$C_{24}$ alkyl chain or two $C_{12}$–$C_{30}$ alkyl chains, the long chain alkyl groups being most commonly those derived from hydrogenated tallow. Examples of such compounds are ditallowdimethyl ammonium chloride, ditallowdimethyl ammonium methyl sulphate, tallowtrimethyl ammonium chloride, dieicosyldimethyl ammonium chloride, tallowdimethyl (3-tallowalkoxypropyl) ammonium chloride, ditetradecyldimethyl ammonium chloride, didodecyldiethyl ammonium acetate and tallowtrimethyl ammonium acetate.

(b) Amido alkoxylated quaternary ammonium compounds. Quaternary compounds of this type can be prepared from fatty acids or triglycerides and an amine e.g. diethylene triamine. The product is then alkoxylated with ethylene oxide or propylene oxide and quaternised with dimethyl sulphate. Compounds of type (ii) can be represented by the formula

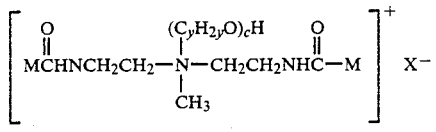

wherein M represents a fatty alkyl group typically $C_{12}$ to $C_{20}$, X represents for example Cl, Br or the methyl sulphate group, y is 2 or 3 and c is an integer.

(c) Quaternised amido imidazolines. Compounds of this type can be obtained by heating the alkoxylated product of reacting an amine and a fatty acid or triglyceride as described for type (b) to effect ring closure to the imidazoline. This is then quaternised by reaction with e.g. dimethyl sulphate. An example of a type (c) compound is 2-heptadecyl-1-methyl-1-(2'-stearoyl amidoethyl)-imidazolinium methyl sulphate.

(d) Polyamine salts and polyalkylene imine salts e.g.

$$[C_{12}H_{25}NH(CH_3)-(CH_2)_3-NH_2C_{12}H_{25}]^{++}\ Cl_2^-,$$

$$[C_{18}H_{37}NH(CH_3)-(CH_2)_2-NH(C_2H_5)_2]^{++}\ (CH_3SO_4)^-_2$$

and a polyethylene iminium chloride having about 10 ethylene imine units.

(e) Alkyl pyridinium salts e.g. cetyl pyridinium chloride.

The generally preferred cationic softening agents are those having long chain, fatty alkyl groups derived from tallow or hydrogenated tallow and the generally preferred class of softening agents are those of type (a), that is the alkylmethyl ammonium compounds.

Fabric conditioning agents which may be employed as component (A) of the compositions of this invention are well-known substances and have been widely described in the technical literature, see for example, J. Am. Oil Chemists Soc., January 1978 (Vol 55), pages 118–121 and Chemistry and Industry, 5th July 1969, pages 893–903.

Component (B) of the compositions of this invention is a mixture of a resinous branched polyorganosiloxane (i) in which the organic substituents are predominantly alkyl groups having from 1 to 8 carbon atoms and a low viscosity polydiorganosiloxane (ii) wherein at least 90 percent of the organic substituents are methyl. Polyorganosiloxane (i) comprises at least 90 percent of units $RSiO_{3/2}$ wherein R represents an alkyl group having from 1 to 8 carbon atoms and is preferably pentyl. Any remaining units which may be present in the polyorganosiloxane are selected from those of the general formula $$R_n'SiO_{\frac{4-n}{2}}$$

wherein R' is methyl, ethyl, propyl or butyl or phenyl and n has a value of 0, 2 or 3 and $PhSiO_{3/2}$ units. Such remaining units therefore include $CH_3SiO_{3/2}$, $(CH_3)_2SiO$, $C_6H_5(CH_3)SiO$, n-$PrSiO_{3/2}$, $C_6H_5SiO_{3/2}$, $(CH_3)_3SiO_{1/2}$ and $SiO_2$ units. Polyorganosiloxanes (i) may be prepared by known methods, for example by the hydrolysis of $RSiCl_3$, or cohydrolysis with $$R_n'SiCl_{\frac{4-n}{2}},$$

, and condensation of the hydrolysis product.

Polydiorganosiloxanes (ii) are known and commercially available substances. They can be described as linear or substantially linear polymers having a ratio of organic substituents to silicon atoms of two or approximately two and can be represented by the average unit general formula $$X_ySiO_{\frac{4-y}{2}}$$

wherein X represents the organic substituent and y has a value of approximately 1.9 to about 2.4. At least 90 percent of the organic substituents (X) in the polydiorganosiloxane should be methyl with any remaining substituents being monovalent hydrocarbon groups having from 2 to 18 carbon atoms, for example ethyl, propyl, butyl, pentyl, decyl, octadecyl, vinyl or phenyl. The preferred polydiorganosiloxanes are the polydimethylsiloxanes. It is also preferred that the polydiorganosiloxanes have a viscosity at 25° C. in the range from 10 to 500 mPa.s. The polydiorganosiloxane may or may not be end-stopped. For example the terminal silicon atoms may have attached thereto —OH or —ONa groups or the terminal positions may be occupied by triorganosiloxy groups, for example trimethylsiloxy, dimethylvinylsiloxy, dimethylphenylsiloxy or methylphenylvinylsiloxy units.

The polydiorganosiloxanes (ii) act as solvents for the polyorganosiloxanes (i) and are readily miscible therewith. The proportion of (i) in Component (B) may vary from 55 to 95 weight percent. However, the optimum balance of rewettability and softness appears to be obtained when the polyorganosiloxane (i) is employed in a proportion of from 70 to 90 percent by weight.

The compositions of this invention comprise water having (A) and (B) dispersed therein. The cationic compounds (A) are generally soluble in water to some extent and may thus exist in the compositions of this invention dissolved or dispersed in the aqueous phase. The organosiloxane mixture (B) is substantially insoluble in water. Thus, the term 'dispersion' as employed herein is intended to include solutions as well as emulsions or other forms of dispersion wherein the disperse phase is insoluble in the aqueous phase. The compositions may be prepared by mixing (A) with the mixture of organosiloxanes (B) and thereafter emulsifying the resulting mixture in water. More conveniently, however, (A) and (B) are separately dispersed in water and the resulting dispersions mixed together, or alternatively (A) may be added to and dispersed in an aqueous emulsion of (B). Depending on the solubility characteristics of (A) emulsifying agents may be employed to facilitate dispersion in the aqueous phase or to stabilise the dispersion. The organosiloxane mixture (B) may be emulsified in water employing any suitable emulsifying agent. Preferred for this purpose are the non-ionic emulsifying agents examples of which are the ethoxylated alcohols, ethoxylated alkyl phenols, ethoxylated fatty acids, ethoxylated fatty acid esters and esters of sorbitan and glycerol. However, the nature of the emulsifying agent is not critical provided it is capable of producing a substantially stable emulsion of the organosiloxane mixture (B).

The concentration of (A) and (B) present in the aqueous compositions of this invention is not critical and depends on practical and commercial considerations. For example, the compositions should be sufficiently fluid as to be readily dispersible during the laundering operation. Also, they should preferably be not so dilute as to involve the cost of storing or transporting large volumes of water. Having regard to such considerations the preferred aqueous compositions are those wherein (A) and (B) are present in a total amount of from about 5% to 35% by weight based on the total weight of the composition.

Depending on the effect desired the relative proportions of (A) and (B) may be varied within wide limits, for example from 1 to 50 parts by weight of the cationic compound (A) per part by weight of (B). For the optimum balance of properties and economy it is preferred to employ from about 2 to 20 parts by weight of (A) per part by weight of (B).

The aqueous compositions may contain in addition to (A), (B) and water other, optional, ingredients for example perfumes, viscosity control agents, optical brighteners, colorants, opacifying agents, soil release agents, biocides and fabric treating agents such as the fatty acid esters of monohydric and polyhydric alcohols. Such additional ingredients may be added to the preformed aqueous composition comprising (A) and (B) or may be incorporated in admixture with (A) and (B).

The compositions of this invention can be employed to treat textiles by any suitable technique, for example by immersion of the textile in an aqueous liquor containing (A) and (B). They are particularly adapted for use as fabric conditioners in domestic and commercial laundry operations by addition at the rinsing stage of the washing cycle. In use the compositions of this invention are added to the rinse water in sufficient quantity to provide the desired effect. Generally the compositions will be added to provide from 5 to 500 parts by weight of (A) and (B) combined per million parts of rinse water.

Fabrics, for example of cotton, polyester cotton or wool, treated with the compositions of this invention have a soft pleasant feel and generally exhibit a firmer 'body' and improved rewettability when compared with fabrics treated with the cationic compounds (A) alone or in combination with polydimethylsiloxanes.

The following examples, in which the parts and percentages are expressed by weight, illustrate the invention.

EXAMPLE 1

A polyamylsiloxane was prepared by the hydrolysis of isoamyl trichlorosilane ($C_5H_{11}SiCl_3$) in a mixture of toluene and water followed by condensation of the hydrolysis product. The resulting siloxane was a liquid having a viscosity of approximately 23,000 mPa.s at 25° C. The polyamylsiloxane (80 parts) was thoroughly mixed with a polydimethylsiloxane having a viscosity of 350 mPa.s at 25° C. (20 parts) and the resulting mixture (330 parts) emulsified in 637 parts of water by passage through a colloid mill and employing as an emulsifying agent 33 parts of Tergitol TMN 6 (a polyoxyethylene trimethylnonyl ether). The resulting non-ionic emulsion was designated Emulsion NA.

By a similar technique a cationic emulsion of the mixture of organosiloxanes was prepared according to the following formulation:

| | |
|---|---|
| Organosiloxane mixture | 350 parts |
| Arquad 2C-75 (a 75% w/w solution in water of discocodimethyl ammonium chloride) | 10 parts |
| Tergitol TMN-6 | 10 parts |
| Acetic Acid | 1 part |
| Water | 584 parts |

The resulting emulsion was designated Emulsion CA.

A series of fabric conditioning compositions was prepared by adding 1%, 2% or 3% by weight of Emulsion NA or Emulsion CA to a 6% solution in water of di(hydrogenated tallow)dimethylammonium chloride and thereafter adding sufficient water to restore the total content of active ingredients (siloxane plus quaternary compound) to 6%. For example when 2 parts of emulsion NA was added to 100 parts of the 6% quaternary compound solution this was followed by the addition of 9.1 parts of water to provide a fabric conditioning composition containing 0.67 part siloxane and 5.33 parts quaternary compound per 100 parts water. The solution of the quaternary compound was prepared employing a small amount of surface active agent to stabilise the solution.

Each of the fabric conditioning compositions, and a composition to which no siloxane had been added were dispersed in water at a rate to provide 3 g of the active components (siloxane plus quaternary) per 2 liters of water, the pH of the resulting dispersions being thereafter adjusted to 4.5 by the addition of acetic acid. Each of the dispersions was then employed to treat pre-laundered samples of cotton, polyester cotton and cotton towelling woven fabrics by immersion for 15 minutes at 22° C. Following immersion the samples were allowed to drain and dry at 22° C. for 24 hours.

All of the treated samples were softer and less harsh to the touch than the untreated fabrics. However, those treated with the siloxane-containing compositions were firmer with more 'body'.

The ability of the treated samples to absorb water (rewettability) was tested by placing a standard size drop of water on the sample held in gentle tension over the mouth of a beaker. The time taken for the drop to become absorbed into the fabric was recorded and the results obtained are shown in the following table.

| | Time (Seconds) | | |
|---|---|---|---|
| Composition | Cotton | Polyester-Cotton | Cotton Towelling |
| 0% siloxane | 35 | 17 | 25 |
| 1% Emulsion NA | 5 | 8 | 3 |
| 2% Emulsion NA | 4 | 7 | 2 |
| 3% Emulsion NA | 4 | 6 | 2 |
| 1% Emulsion CA | 5 | 6 | 2 |
| 2% Emulsion CA | 4 | 6 | 2 |
| 3% Emulsion CA | 3 | 5 | 1 |

EXAMPLE 2

The procedure of Example 1 was repeated except that the siloxane mixture contained 60 parts of the polyamylsiloxane and 40 parts of the polydimethylsiloxane. The rewettability of the treated fabrics was similar to that obtained according to Example 1, but the handle was firmer and less preferred.

EXAMPLE 3

The procedure of Example 2 was repeated except that the polydimethylsiloxane had a viscosity of 50 mPa.s at 25° C. The handle and rewettability of the treated fabrics was similar to that obtained according to Example 2.

That which is claimed is:

1. An aqueous composition which comprises water having dispersed therein (A) a cationic compound which is substantive to water rinse on textile fibers, and (B) a mixture comprising (i) from 95 to 55 percent by weight of a resinous branched polyorganosiloxane wherein at least 90 percent of the siloxane units are those represented by the general formula $RSiO_{3/2}$ in which R represents an alkyl group having from 1 to 8 inclusive carbon atoms, any remaining units in the polyorganosiloxane being selected from units having the general formula $$R_n'SiO_{\frac{4-n}{2}}$$

in which each R' represents an alkyl group having from 1 to 4 carbon atoms or a phenyl group and n has a value of 0, 2 or 3 and $PhSiO_{3/2}$ units in which Ph represents the phenyl group, and (ii) a solvent for the polyorganosiloxane which is from 5 to 45 percent by weight of a low viscosity polydiorganosiloxane having a viscosity in the range from 2 to 1000 mPa.s at 25° C. and in which at least 90 percent of the total organic substituents are methyl, any remaining substituents being selected from monovalent hydrocarbon groups having from 2 to 6 carbon atoms.

2. A composition as claimed in claim 1 wherein the siloxane mixture (B) comprises from 70 to 90 percent by weight of polyorganosiloxane (i) and from 30 to 10 percent by weight of polydiorganosiloxane (ii).

3. A composition as claimed in claim 2 wherein the polydiorganosiloxane (ii) is a polydimethylsiloxane.

4. A composition as claimed in claim 1 wherein there are present from 2 to 20 parts by weight of (A) per part by weight of (B).

5. A process for treating a textile which comprises immersing a textile in an aqueous liquor containing a composition as claimed in claim 1, there being present in said aqueous liquor from 5 to 500 parts by weight of (A) and (B) per million parts by weight of water.

6. A composition as claimed in claim 1 wherein there are present 1 to 50 parts by weight of (A) per part by weight of (B).

7. A composition as claimed in claim 1 wherein (A) and (B) are present in a total amount of from about 5% to 35% by weight based on the total weight of the composition.

8. A composition as claimed in claim 1 wherein the polydiorganosiloxane has a viscosity in the range of from 10 to 500 mPa.s at 25° C.

9. A composition as claimed in claim 1 wherein the polydiorganosiloxane has a viscosity at least as low as 2 mPa.s at 25° C.

10. A composition as claimed in claim 1 wherein the polydiorganosiloxane has a viscosity at least as low as 10 mPa.s at 25° C.

11. A composition as claimed in claim 1 wherein the polydiorganosiloxane has a viscosity of 50 mPa.s at 25° C.

12. A composition as claimed in claim 1 wherein the polyorganosiloxane is polyamylsiloxane.

* * * * *